US008336302B2

(12) United States Patent
Nakahira

(10) Patent No.: US 8,336,302 B2
(45) Date of Patent: Dec. 25, 2012

(54) EXHAUST DEVICE FOR A DIESEL ENGINE

(75) Inventor: Toshio Nakahira, Sakai (JP)

(73) Assignee: Kubota Corporation, Osaka (JP)

( * ) Notice: Subject to any disclaimer, the term of this patent is extended or adjusted under 35 U.S.C. 154(b) by 632 days.

(21) Appl. No.: 12/399,418

(22) Filed: Mar. 6, 2009

(65) Prior Publication Data

US 2009/0285724 A1 Nov. 19, 2009

(30) Foreign Application Priority Data

May 15, 2008 (JP) ..... 2008-128336

(51) Int. Cl.
*B01D 53/34* (2006.01)
*F01N 3/025* (2006.01)
*F01N 3/035* (2006.01)

(52) U.S. Cl. ..... 60/303; 60/286; 60/287; 60/288; 60/289; 60/297; 60/300

(58) Field of Classification Search ..... 60/286, 60/287, 288, 289, 297, 300, 303
See application file for complete search history.

(56) References Cited

U.S. PATENT DOCUMENTS

| | | | | |
|---|---|---|---|---|
| 4,372,111 | A | 2/1983 | Virk et al. | |
| 4,449,362 | A | 5/1984 | Frankenberg et al. | |
| 5,417,059 | A * | 5/1995 | Hartel et al. | 60/276 |
| 5,829,248 | A * | 11/1998 | Clifton | 60/286 |
| 6,021,639 | A * | 2/2000 | Abe et al. | 60/297 |
| 7,150,146 | B2 * | 12/2006 | Blaschke et al. | 60/286 |
| 8,006,487 | B2 * | 8/2011 | Gaiser | 60/303 |
| 2006/0021332 | A1 | 2/2006 | Gaiser | |
| 2006/0096282 | A1 | 5/2006 | Friedrich et al. | |
| 2007/0193254 | A1 * | 8/2007 | Johannes | 60/286 |
| 2008/0000219 | A1 * | 1/2008 | Ratcliff et al. | 60/274 |
| 2008/0092526 | A1 * | 4/2008 | Kunkel et al. | 60/286 |
| 2008/0282687 | A1 * | 11/2008 | Park et al. | 60/300 |

FOREIGN PATENT DOCUMENTS

| | | | |
|---|---|---|---|
| DE | 102005030954 | A1 | 1/2007 |
| DE | 102005039630 | A1 | 3/2007 |
| JP | 58020981 | A | 2/1983 |
| JP | 60135612 | A | 7/1985 |
| JP | 2005-256769 | A | 9/2005 |
| JP | 2005320880 | A | 11/2005 |
| JP | 2007-239734 | A | 9/2007 |
| JP | 2008-019796 | A | 1/2008 |

(Continued)

*Primary Examiner* — Thomas Denion
*Assistant Examiner* — Brandon Lee
(74) *Attorney, Agent, or Firm* — Panitch Schwarze Belisario & Nadel LLP

(57) ABSTRACT

A flammable-gas led-out pipe (5) has a terminal end portion (5*a*) disposed in an exhaust-gas route (7) and a metal cylinder (10) is arranged at the terminal end portion (5*a*) of the flammable-gas led-out pipe (5). An oxidation catalyst (8) is disposed within the metal cylinder (10). On an upstream side of the oxidation catalyst (8), an air-supply passage (12) is opened to provide an outlet (12*a*) and the flammable gas (4) merges with supplied air (13). The flammable gas (4) is burnt with the oxidation catalyst (8) to produce catalyst-combustion heat, which is radiated from an outer peripheral surface of the metal cylinder (10) into the exhaust gas (9) in the exhaust-gas route (7) and the exhaust gas (9) heated by this heat-radiation is mixed with the flammable gas (4) that has passed through the oxidation catalyst (8).

14 Claims, 3 Drawing Sheets

FOREIGN PATENT DOCUMENTS

| | | | |
|---|---|---|---|
| JP | 2008-075610 | A | 4/2008 |
| JP | 2008-215193 | A | 9/2008 |
| JP | 2008-232061 | A | 10/2008 |
| WO | WO 2007037652 | A1 * | 4/2007 |

* cited by examiner

FLAMABLE GAS
SUPPLIED AIR
EXHAUST GAS
4
5
12
13
9
7
(29)
5a(10)
52
56
55
51(15)
50
5c
14
14a
5b
38
8
53
54
12a
13
A
B
C
D 1
2
3
4
5
5a
6
7
9
10
12
13
17
18
19
20
21
22
23
24
25
26
27
28
29
30
31
32
33
34
35
36
41
42
43
44
45
45a
46
47
48
50
54
57

FLAMABLE GAS
SUPPLIED AIR
EXHAUST GAS (29)7
5a(50)
5b

EXHAUST DEVICE FOR A DIESEL ENGINE

TECHNICAL FIELD

The present invention concerns an exhaust device for a diesel engine and more specifically relates to an exhaust device for a diesel engine able to ensure the combustion of flammable gas and to inhibit the damage of an oxidation catalyst caused by heat.

BACKGROUND ART

An example of the conventional exhaust devices for a diesel engine comprises a liquid-fuel supply source which supplies liquid fuel to a gas generator, which converts the liquid fuel to flammable gas as well as the present invention. A flammable-gas pipe led out of the gas generator is communicated with an exhaust-gas route on an upstream side of a diesel-particulate-filter. An oxidation catalyst is arranged upstream of this filter in the exhaust-gas route and the flammable gas is burnt with the oxidation catalyst to produce combustion heat that heats the exhaust gas. The thus heated exhaust gas burns the exhaust-gas fine particles remaining at the filter.

However, in the conventional exhaust device for a diesel engine, the flammable gas is burnt only with the oxygen contained in the exhaust gas, and besides no igniting means is provided. Therefore, it causes problems.

DISCLOSURE OF THE INVENTION

Problem the Invention Attempts to Solve

The above-mentioned conventional technique has the following problems.

<Problem> The flammable gas sometimes does not burn.

The flammable gas is burnt only with the oxygen contained in the exhaust gas. This causes a case where if the oxygen contained in the exhaust gas is insufficient, the flammable gas cannot be burnt.

<Problem> The oxygen catalyst is sometimes damaged by heat.

Due to uneven concentration-distribution of the oxygen in the exhaust gas, a high-temperature combustion portion is liable to be produced locally in the oxidation-catalyst to thereby cause a likelihood of heat-damaging the oxidation catalyst <Problem> With a low exhaust-gas temperature, there is sometimes caused a case where the flammable gas mixed with the exhaust gas may not be burnt.

Since there is no means for igniting the flammable gas, if the exhaust-gas has a low temperature, the flammable gas mixed with the exhaust gas is not sometimes burnt.

The present invention has an object to provide an exhaust device for a diesel engine capable of solving the above-mentioned problems; that is to say, able to ensure the combustion of the flammable gas and to inhibit the heat-damaging of the oxidation catalyst.

Means for Solving the Problem

The inventive featuring matter of the invention as set forth in claim 1 is as follows.

As exemplified in FIG. 2, an exhaust device for a diesel engine comprises a liquid-fuel supply source 1 that supplies liquid fuel 3 to a gas generator 2 which converts the liquid fuel 3 to flammable gas 4, a flammable-gas pipe 5 being led out of the gas generator 2 and communicated with an exhaust-gas route 7 upstream of a diesel-particulate-filter 6, on an upstream side of which oxidation catalysts 8, 57 are disposed in the exhaust-gas route 7 and the flammable gas 4 is burnt with the oxidation catalysts 8, 57 to produce combustion heat that heats exhaust gas 9. The thus heated exhaust gas 9 can burn the exhaust-gas fine particles clogging the filter 6.

In the above exhaust device for a diesel engine, as exemplified in FIG. 1(A) or FIG. 3(A), the flammable-gas led-out pipe 5 has a terminal end portion 5*a* arranged in the exhaust-gas route 7 and a metal cylinder 10 is disposed at the terminal end portion 5*a* of the flammable-gas led-out pipe 5 and the oxidation catalyst 8 is arranged within the metal cylinder 10. On an upstream side of the oxidation catalyst 8, an air-supply passage 12 is opened to provide an outlet 12*a* and the flammable gas 4 merges with supplied air 13. The flammable gas 4 is burnt with the oxidation catalyst 8 to produce combustion heat, which is radiated from an outer peripheral surface of the metal cylinder 10 into the exhaust gas 9 in the exhaust-gas route 7 and the exhaust gas 9 heated by this heat-radiation is mixed with the flammable gas 4 that has passed through the oxidation catalyst 8.

Effect of the Invention (Invention of Claim 1)

<Effect> The flammable gas can be assuredly burnt.

As illustrated in FIG. 1(A) or FIG. 3(A) for example only, on an upstream side of the oxidation catalyst 8 the air-supply passage 12 is opened to provide the outlet 12*a* and the flammable gas 4 merges with the supplied air 13. This ensures the combustion of the flammable gas 4 even with a small amount of oxygen present in the exhaust pas 9.

<Effect> It is possible to inhibit the heat-damaging of the oxidation catalyst.

Owing to the fact that the concentration-distribution of the oxygen is uniform in the supplied air 13, a high-temperature combustion portion hardly occurs locally in the oxidation catalyst 8 with the result of being able to prevent the heat-damaging of the oxidation catalyst 8 attributable to this unfavorable local occurrence of the high-temperature portion.

<Effect> Even with the exhaust-gas having a low temperature, the flammable gas mixed with the exhaust gas can be burnt assuredly.

As shown in FIG. 1(A) or FIG. 3(A), the flammable gas 4 is burnt with the oxidation catalyst 8 to produce combustion heat, which is radiated from the outer peripheral surface of the metal cylinder 10 into the exhaust gas 9 in the exhaust-gas route 7. The exhaust gas 9 heated by this heat-radiation is mixed with the flammable gas 4 that has passed through the oxidation catalyst 8. This enhances the temperature of the exhaust gas 9 by the heat-radiation from the outer peripheral surface of the metal cylinder 10 and can ensure the combustion of the flammable gas 4 mixed with the exhaust gas 9 even if the exhaust gas 9 has a low temperature.

(Invention of Claim 2)

This invention offers the following effect in addition to that of the invention as defined in claim 1.

<Effect> The exhaust-gas route never experiences the unnecessary increase of its inner diameter.

As exemplified in FIG. 1(A) or FIG. 3(A), each of the terminal end portion 5*a* of the flammable-gas led-out pipe 5 and the metal cylinder 10 has an axial direction extended along an axial direction of the exhaust-gas route 7. This prevents the inner diameter of the exhaust-gas route 7 from unnecessarily increasing.

<Effect> Mis-ignition of the flammable gas hardly occurs attributable to the pulsation of the exhaust gas.

As exemplified in FIG. 1(A) or FIG. 3(A), the metal cylinder 10 that serves as the heat-radiation portion has its axial direction extended along the axial direction of the exhaust-gas route 7. The metal cylinder 10 has an interior area a portion of which exists on a downstream side of the oxidation catalyst 8 and is made to serve as an oxidation-catalyst downstream chamber 14. An outlet 14*a* of the oxidation-catalyst downstream chamber 14 has been directed toward the downstream side of the exhaust-gas route 7 as well as a terminal end opening 5*b* of the flammable-gas led-out pipe 5. Thus by setting the length of each of the metal cylinder 10 and the oxidation-catalyst downstream chamber 14 to a certain one, even if the flammable gas 4 moves at a high speed within the exhaust-gas route 7 along an axial direction thereof by the pulsation of the exhaust gas, it remains in continuous contact with the outer peripheral surface of the metal cylinder 10 and an inner peripheral surface of the oxidation-catalyst downstream chamber 14, thereby enabling the heat-radiation therefrom to ignite the flammable gas. Therefore, the mis-ignition of the flammable gas 4 hardly occurs attributable to the pulsation of the exhaust gas.

(Invention of Claim 3)

It offers the following effect in addition to that of the invention as defined in claim 2.

<Effect> It is possible to secure the activation temperature of the oxidation catalyst.

As exemplified in FIG. 2, a control means 19 adjusts an opening degree of an air-metering valve 18 so as to maintain the temperature of the oxidation catalyst 8 within a predetermined range. This makes it possible to secure the activation temperature of the oxidation catalyst 8.

<Effect> The oxidation catalyst can be protected from being damaged by heat.

As illustrated for example only in FIG. 2, the control means 19 adjusts the opening degree of the air-metering valve 18 so as to keep the temperature of the oxidation catalyst 8 within the predetermined range, which results in the ability to protect the heat-damaging of the oxidation catalyst.

(Invention of Claim 4)

It offers the following effect in addition to that of the invention as defined in any one of claims 1 to 3.

<Effect> The flammable gas can be easily obtained.

The gas generator 2 gasifies the liquid fuel 3 so that the thus gasified liquid fuel 3 can serve as the flammable gas 4. Therefore, the flammable gas 4 can be easily obtained.

(Invention of Claim 5)

It offers the following effect in addition to that of the invention as defined in any one of claims 1 to 3.

<Effect> Even the exhaust gas of a low temperature can burn the flammable gas.

The gas generator 2 partly oxidizes the liquid fuel 3, thereby enabling the flammable gas 4 containing carbon monoxide and hydrogen to be reformed. In consequence, the flammable gas 4 is ignited even at a relatively low temperature, so that even with the exhaust gas 9 of a low temperature, the flammable gas 4 can be burnt.

(Invention of Claim 6)

It offers the following effect in addition to that of the invention as defined in any one of claims 1 to 5.

<Effect> Even with the exhaust gas of a low temperature, the flammable gas to be mixed with the exhaust gas can be surely burnt.

As exemplified in FIG. 1A or FIG. 3(A), part of the exhaust gas 9 in the exhaust-gas route 7 passes through an exhaust-gas heating passage 51 and a combustion heat produced with the oxidation catalyst 8 is radiated from the outer peripheral surface of the metal cylinder 10 into the exhaust gas 9 in the exhaust-gas heating passage 15. In consequence, even if the exhaust gas 9 has a low temperature, the heat-radiation is executed collectively to part of the exhaust gas 9 on the outer peripheral surface of the metal cylinder 10, thereby enabling the temperature of the exhaust gas to increase with the result of assuredly burning the flammable gas 4 to be mixed with the exhaust gas 9.

(Invention of Claim 7)

It offers the following effect in addition to that of the invention as defined in claim 6.

<Effect> Even with the exhaust gas of a low temperature, it is possible to ensure the combustion of the flammable gas mixed in the exhaust gas.

As exemplified in FIG. 1(A), part of the exhaust gas 9 in the exhaust-gas route 7 is mixed with part of the flammable gas 4 that has passed through the oxidation catalyst 8. Therefore, even if the exhaust gas has a low temperature, the flammable gas in the exhaust-gas heating passage 51 is ignited by the heat radiated from the outer peripheral surface of the metal cylinder 10, thereby enabling the flammable gas mixed in the exhaust gas 9 to be surely burnt.

(Invention of Claim 8)

It offers the following effect in addition to that of the invention as defined in claim 6 or 7.

<Effect> With the exhaust gas of a low temperature, it is possible to burn the flammable gas to be mixed with the exhaust gas assuredly.

As exemplified in FIG. 1(A) or FIG. 3(A), the outer cylinder 50 is formed from metal and is thermo-conductively connected to the metal cylinder 10. Further, the combustion heat produced with the oxidation catalyst 8 is also radiated from an inner peripheral surface of the outer cylinder 50 into the exhaust gas 9 in the exhaust-gas heating passage 51. Therefore, even with the exhaust gas 9 of a low temperature, the heat-radiation is collectively executed to part of the exhaust gas 9 on the inner peripheral surface of the outer cylinder 50, thereby enabling the temperature of the exhaust gas 9 to increase with the result of being able to ensure the combustion of the flammable gas 4 to be mixed with the exhaust gas 9.

(Invention of Claim 9)

It offers the following effect in addition to that of the invention as defined in any one of claims 1 to 8.

<Effect> It is possible to inhibit the heat-damaging of the oxidation-catalyst.

As exemplified in FIG. 1(A) or FIG. 3(A), there is provided between the outlet 12*a* of the air-supply passage 12 and the oxidation catalyst 8, an air-mixing passage 54 in which a throttle orifice 52 and an expansion chamber 53 are alternatively arranged and the flammable gas 4 is mixed with the supplied air 13. Thus the supplied air 13 is uniformly mixed with the flammable gas 4 and therefore a high-temperature combustion portion hardly occurs locally in the oxidation catalyst 8, whereby the oxidation catalyst 8 can be inhibited from being heat damaged attributable to the local occurrence of the high-temperature combustion portion.

(Invention of Claim 10)

It offers the following effect in addition to that of the invention as defined in any one of claims 1 to 9.

<Effect> The number of parts can be decreased.

As illustrated in FIG. 1(A), the metal cylinder 10 is formed from the terminal end portion 5*a* of the flammable-gas led-out pipe 5. This dispenses with preparing these parts as separate ones and therefore decreases the number of parts.

(Invention of Claim 11)

It offers the following effect in addition to that of the invention as defined in any one of claims 6 to 8.

<Effect> The number of parts can be decreased.

As illustrated in FIG. 3(A), the metal cylinder 50 is composed of the terminal end portion 5*a* of the flammable-gas led-out pipe 5. This dispenses with preparing these parts as separate ones and therefore can decrease the number of parts.

(Invention of Claim 12)

It offers the following effect in addition to that of the invention as defined in any one of claims 1 to 11.

<Effect> Even if the exhaust gas has a low temperature, it is possible to burn the flammable gas to be mixed in the exhausts gas assuredly.

As exemplified in FIG. 2(A) and FIG. 2(B), on an upstream of the filter 6, a downstream oxidation catalyst 57 is disposed downstream of the metal cylinder 10, from which the flammable gas 4 is released and is burnt with the downstream oxidation catalyst 57. The exhaust gas 9 with its temperature increased by the effect of the oxidation catalyst 8 within the metal cylinder 10 enhances the catalyst activity of the downstream oxidation catalyst 57 and the flammable gas 4 is burnt with the downstream oxidation catalyst 57 to produce combustion heat, which further increase the temperature of the exhaust gas 9. In consequence, even if the exhaust gas 9 has a low temperature, it is possible to surely burn the flammable gas to be mixed in the exhaust gas 9.

BRIEF DESCRIPTION OF THE DRAWINGS

[FIG. 1] shows an essential portion of an exhaust device for a diesel engine according to a first embodiment of the present invention.

[FIG. 2]

[FIG. 3] shows an essential portion of an exhaust device for a diesel engine according to a second embodiment of the present invention.

PREFERRED EMBODIMENT OF THE INVENTION

Figures 1A, 1B, 1C, 1D:
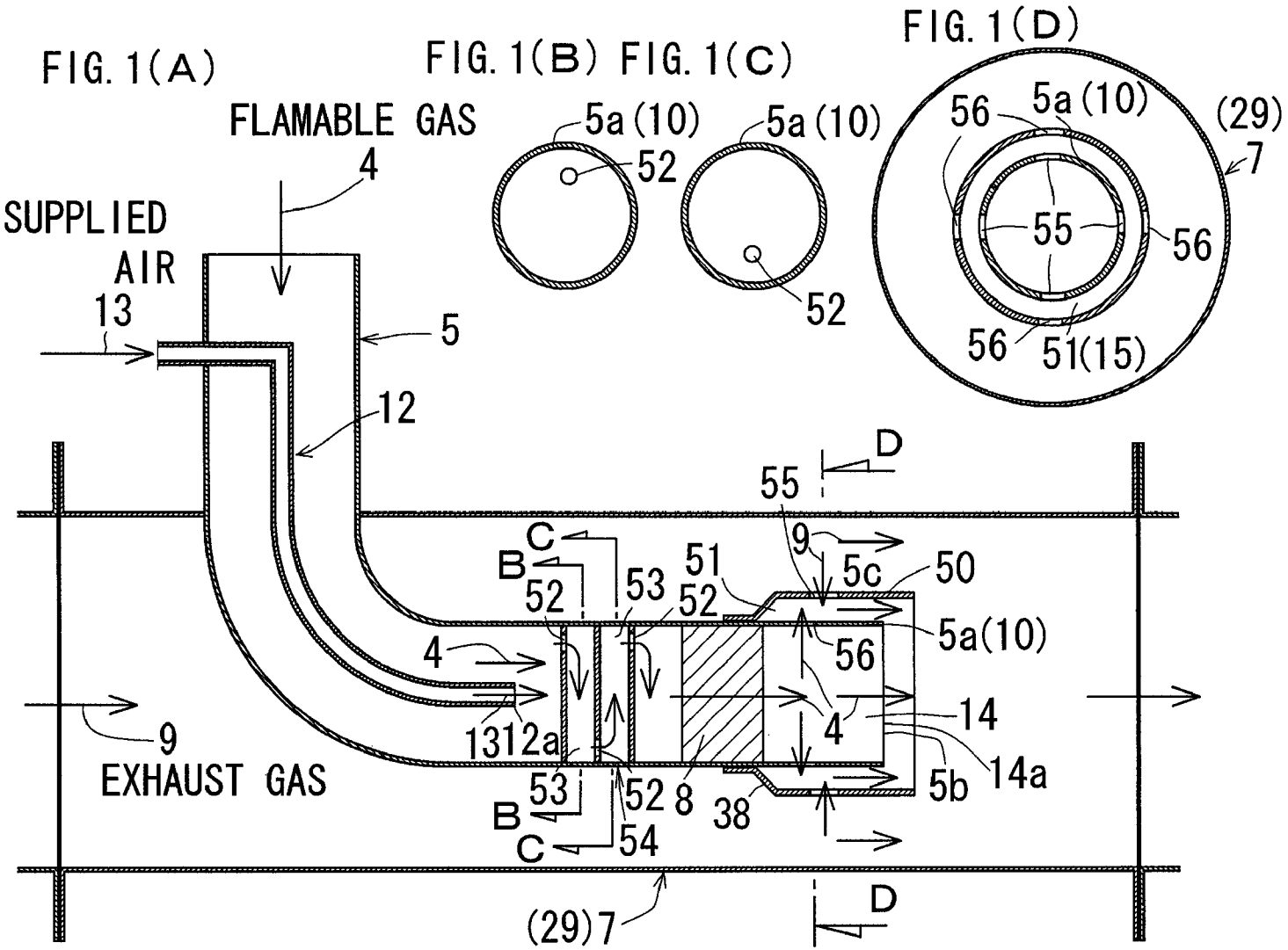
FIG. 1(A) is a vertical sectional side view of FIG. 1(A).
FIG. 1(B) is a sectional view taken along a line B-B in FIG. 1(A).
FIG. 1(C) is a sectional view taken along a line C-C in FIG. 1(A).
FIG. 1(D) is a sectional view taken along a line D-D in FIG. 1(A).

Embodiments of the present invention are explained based on the attached drawings. FIGS. 1 and 2 show an exhaust device for a diesel engine according to a first embodiment of the present invention. FIG. 3 shows a second embodiment according to the present invention. In each of these embodiments, an explanation is given to an exhaust device for a multi-cylinder vertical diesel engine.

The first embodiment of the present invention is outlined as follows.

This engine, as shown in FIG. 2, comprises a cylinder block 20 onto which a cylinder head 21 is assembled, a head cover 22 being assembled to an upper portion of the cylinder head 21 and an oil pan 23 being assembled to a lower portion of the cylinder block 20, the cylinder block 20 having a front portion to which a gear case 24 is assembled, an engine-cooling fan 25 being arranged at a front portion of the gear case 24, a fly-wheel 26 being disposed at a rear portion of the cylinder block 20. The cylinder head 21 has a lateral side to which an exhaust manifold 27 is assembled. An exhaust-gas pipe 29 is connected to the exhaust manifold 27 via an exhaust-gas led-out pipe 28 and a filter-housing case 30 is connected to the exhaust-gas pipe 29. The filter-housing case 30 houses a diesel-particulate-filter 6, which captures fine particles contained in exhaust gas 9. This engine is provided with a filter-recovery device 31, which burns the exhaust-gas fine particles remaining at the filter 6 so as to recover the filter 6.

The filter-recovery device is outlined as follows.

Figures 2A, 2B:
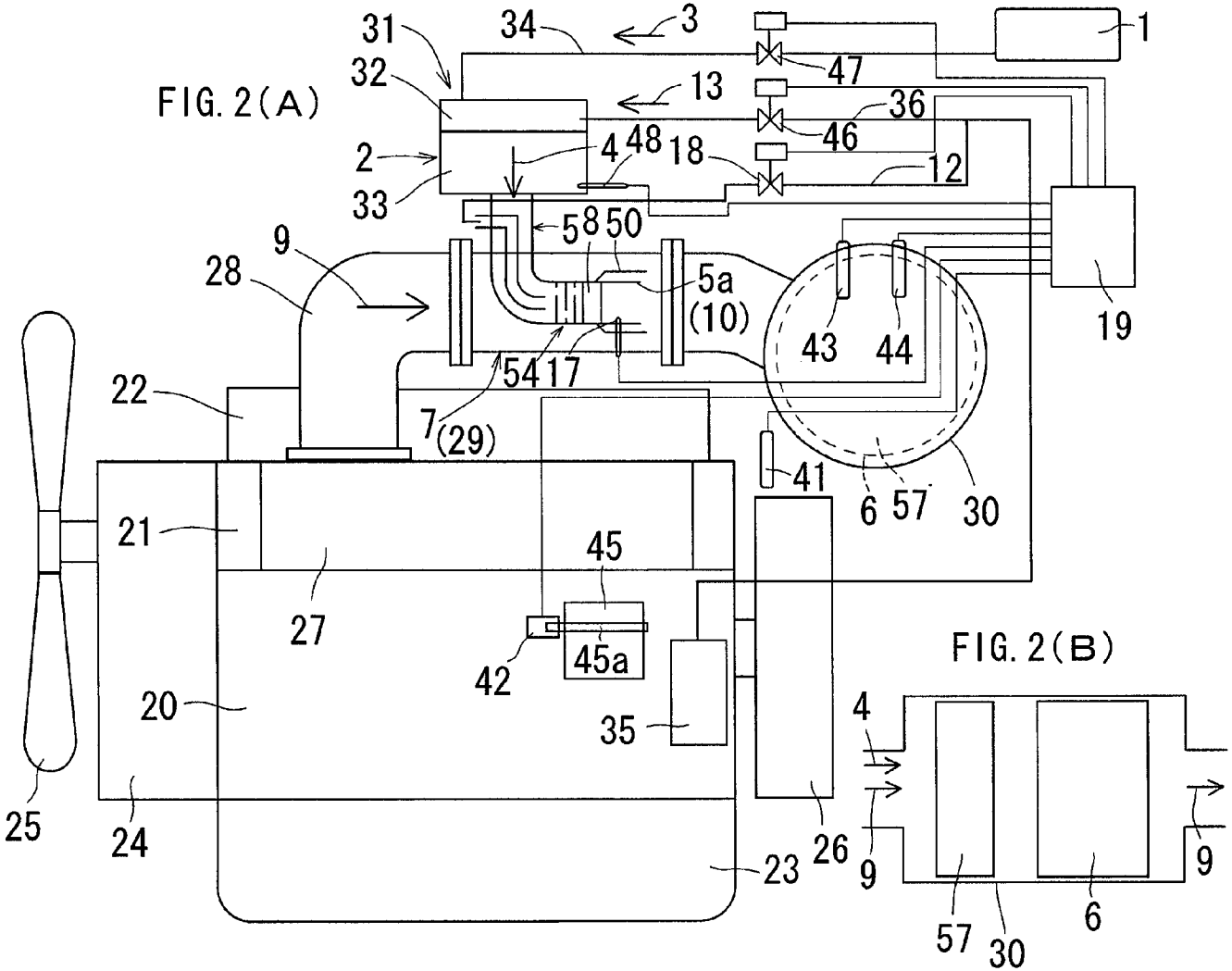
FIG. 2(A) is a schematic view of the diesel engine equipped with an exhaust device according to a second embodiment of the present invention and FIG. 2(B) is a schematic view showing the arrangement of a downstream oxidation catalyst and a filter within a filter-housing case.
Figures 3A, 3B, 3C, 3D:
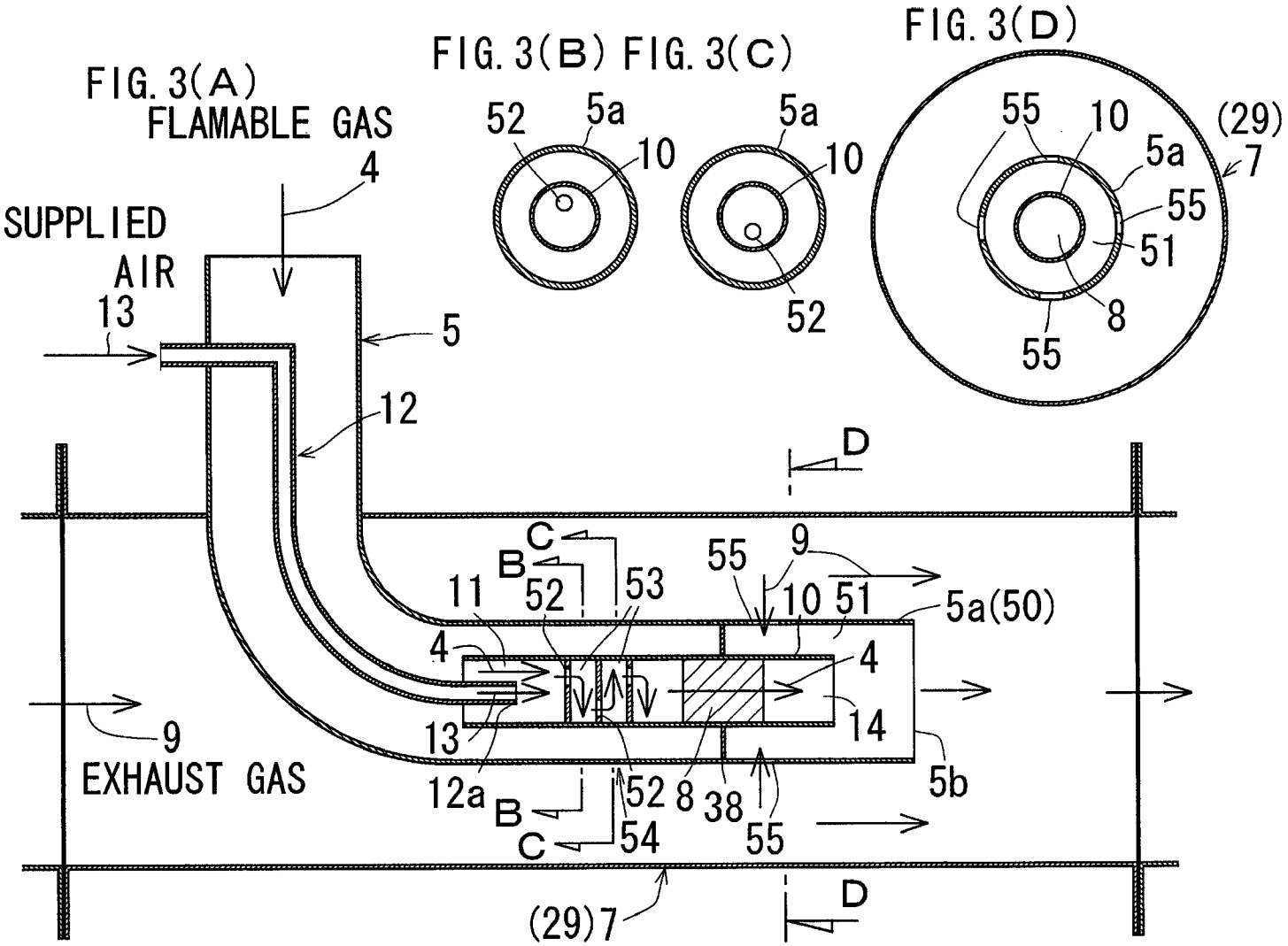
FIG. 3(A) is a vertical sectional side view of FIG. 3(A).
FIG. 3(B) is a sectional view taken along a line B-B in FIG. 3(A).
FIG. 3(C) is a sectional view taken along a line C-C in FIG. 3(A).
FIG. 3(D) is a sectional view taken along a line D-D in FIG. 3(A).

As shown in FIG. 2(A) and FIG. 2(B), a liquid-fuel supplying source 1 supplies liquid fuel 3 to a gas generator 2, which converts the liquid fuel 3 to flammable gas 4. The gas generator 2 has a flammable-gas led-out pipe 5 communicated with an exhaust-gas route 7 on an upstream side of the diesel-particulate-filter 6. Oxidation catalysts 8, 57 are arranged in the exhaust-gas route 7 upstream of the filter 6 so as to burn the flammable gas 4 with the oxidation catalysts 8, 57 to produce combustion heat that heats the exhaust gas 9. The thus heated exhaust gas 9 can burn the exhaust-gas fine particles residual at the filter 6. The oxidation catalysts 8, 57 comprise an upstream oxidation catalyst (combustion catalyst) 8 and a downstream oxidation catalyst 57. The upstream oxidation catalyst 8 is arranged within an exhaust-gas pipe 29. The downstream oxidation catalyst 57 is arranged downstream of the filter 6 within a filter-housing case 30. In the case where only the oxidation catalyst 8 within the exhaust-gas pipe 29 can increase the temperature of the exhaust gas 9 sufficiently, the downstream oxidation catalyst 57 may be omitted.

The filter-recovery device is explained in details as follows.

As shown in FIG. 2(A), the liquid-fuel supply source 1 is a fuel reservoir of light oil, i.e. fuel of the diesel engine. The gas generator 2 is provided with a mixer 32 and a catalyst chamber 33. Connected to the mixer 32 is a liquid-fuel passage 34 led out of the liquid-fuel supply source 1 and an air-passage 36 led out of an air-supply source 35. The liquid fuel 3 is mixed with the supplied air 13 by the mixer 32 so that it becomes flammable gas 4 in the catalyst chamber 33. The air-supply source 35 is an air blower and is driven by a motor. But it may be driven by the engine. The catalyst chamber 33 accommodates a catalyst. In this embodiment, the gas generator 2 gasifies the liquid fuel 3 to convert the liquid fuel 3 to the flammable gas 4. The catalyst within the catalyst chamber 33 is an oxidation catalyst that partly oxidizes the liquid fuel 3 to produce oxidation heat, which gasifies the rest of the liquid fuel 3. The mixing ratio of the supplied air 13 with the liquid fuel 3, namely O/C of air-fuel ratio, is set to around 0.6, namely within a range of 0.4 to 0.8. The catalyst component is selected from a group consisting of platinum series and palladium series.

The liquid fuel 3 may be reformed instead of being gasified. More specifically, the liquid fuel 3 may be reformed to the flammable gas 4 that contains carbon monoxide and hydrogen by partly oxidizing it within the catalyst chamber 33. In this case, a partial oxidation catalyst is used as the catalyst within the catalyst chamber 33 instead of the oxidation catalyst. The mixing ratio of the supplied air 13 with the liquid fuel 3, namely the fuel-air ratio of O/C, is set to around 1.3, i.e. within a range of 1.0 to 1.6. The catalyst component is one of rhodium series.

As shown in FIG. 1(A), the flammable-gas led-out pipe 5 has a terminal end portion 5*a* disposed within the exhaust-gas pipe 29 and the terminal end portion 5*a* of the flammable-gas led-out pipe 5 is formed into a straight circular metal cylinder 10, in which the oxidation catalyst 8 is disposed. The oxidation catalyst 8 is arranged within the metal cylinder 10. On an upstream side of the oxidation catalyst 8, the air-supply passage 12 is opened to provide an outlet 12*a* and the flammable gas 4 merges with the supplied air 13. The flammable gas 4 is burnt with the oxidation catalyst 8 to produce catalyst-combustion heat, which is radiated from an outer peripheral surface of the metal cylinder 10 that extends along a gas-mixing passage 15, into the exhaust gas 9 in the exhaust-gas pipe 29. The exhaust gas 9 heated by this heat-radiation is mixed with the flammable gas 4 that has passed through the oxidation catalyst 8.

As shown in FIG. 1(A), the metal cylinder 10, which is the terminal end portion 5*a* of the flammable-gas led-out pipe 5, has an axial direction made to extend along an axial direction of the exhaust pipe 29. The air-supply passage 12 is branched off from the air led-out passage 36. The oxidation catalyst 8 is closely contacted with an inner peripheral surface of the metal cylinder 10.

As shown in FIG. 1(A) to FIG. 1(D), within the exhaust-gas pipe 29, an outer cylinder 50 is provided coaxially with the metal cylinder 10 along the outer periphery thereof. An exhaust-gas heating passage 51 is arranged between the metal cylinder 10 and the outer cylinder 50, and part of the exhaust gas 9 in the exhaust-gas pipe 29 passes through the exhaust-gas heating passage 51. The catalyst-combustion heat generated with the oxidation catalyst 8 is radiated from the outer peripheral surface of the metal cylinder 10 into the exhaust gas 9 in the exhaust-gas heating passage 51. The outer cylinder 50 is circular and has its upstream side closed by a partition wall 38, through which the outer cylinder 50 is supported by the metal cylinder 10.

Within the exhaust-gas heating passage 51, part of the exhaust gas 9 in the exhaust-gas pipe 29 is mixed with part of the flammable gas 4 that has passed through the oxidation catalyst 8.

The outer cylinder 50 is formed from metal and is thermo-conductively connected to the metal cylinder 10, so that the catalyst-combustion heat generated with the oxidation catalyst 8 is also radiated from an inner peripheral surface of the outer cylinder 50 into the exhaust gas 9 in the exhaust-gas heating passage 51. In other words, the outer cylinder 50 is thermo-conductively connected to the metal cylinder 10 by the metal partition wall 38.

There is arranged between the outlet 12*a* of the air-supply passage 12 and the oxidation catalyst 8, an air-mixing passage 54 in which a throttle orifice 52 and an expansion chamber 53 are alternatively arranged and the flammable gas 4 is mixed with the supplied air 13.

The outer cylinder 50 has a peripheral wall provided with an exhaust-gas introduction port 55 and the metal cylinder 10 has a peripheral wall provided with a flammable-gas introduction port 56. Part of the exhaust gas 9 that passes through the exhaust-gas introduction port 55 to an external side of the outer cylinder 50 is introduced into the exhaust-gas heating passage 51 and part of the flammable gas 4 that has passed through the flammable-gas introduction port 56 to the oxidation catalyst 8 is also introduced into the exhaust-gas heating passage 51.

Further, on an upstream of the filter 6, the downstream oxidation catalyst 57 is arranged downstream of the metal cylinder 10, from which the flammable gas 4 is released and is burnt with the downstream oxidation catalyst 57.

The filter-recovery device heats the exhaust gas as follows.

As shown in FIG. 1(A), on the upstream side of the oxidation catalyst 8, the flammable gas 4 merges with the supplied air 13. Part of the flammable gas 4 performs catalyst-combustion and the remaining part thereof has its temperature enhanced while passing through the oxidation catalyst 8 and flows out to the oxidation-catalyst downstream chamber 14 on the side of a terminal end opening 5*b* of the flammable-gas led-out pipe 5. The flammable gas 4 is burnt with the oxidation catalyst 8 to produce catalyst-combustion heat, which is radiated from the outer peripheral surface of the metal cylinder 10 disposed opposite to the exhaust-gas heating passage 51 and an inner peripheral surface of the outer cylinder 50. The exhaust gas 9 is mixed with the flammable gas 4 within the exhaust-gas heating passage 51 and the flammable gas 4 is ignited by the heat radiated from the outer peripheral surface of the metal cylinder 10 and the inner peripheral surface of the outer cylinder 50 and is burnt with oxygen contained in the exhaust gas 9 to increase the temperature of the exhaust gas 9, which is flowed out to the side of the terminal end opening 5*b* of the flammable-gas led-out pipe 5.

The high-temperature flammable gas 4 flowed out of the oxidation-catalyst downstream chamber 14 and the high-temperature exhaust gas 9 flowed out of the exhaust-gas heating passage 51 are mixed with the exhaust gas 9 present on the outer side of the outer cylinder 50 and the flammable gas 4 is burnt with the oxygen contained in the exhaust gas 9 to further increase the temperature of the exhaust gas 9. The exhaust gas 9 which has its temperature increased as such enhances the catalyst activity of the downstream oxidation catalyst 57. The flammable gas 4 is burnt with the downstream oxidation catalyst 57 to produce catalyst-combustion heat that still more heats the exhaust gas 9. The exhaust gas 9 with its temperature still more increased as such is supplied to the filter 6, so that the exhaust-gas fine particles clogging the filter 6 is burnt to recover the filter 6.

Moreover, even if the flammable gas 4 moves at a high speed within the exhaust-gas pipe 29 along an axial direction thereof by the pulsation of the exhaust gas, it is in continuous contact with the outer peripheral surface of the metal cylinder 10, an inner peripheral surface of the oxidation-catalyst downstream chamber 14 and the inner and outer peripheral surfaces of the outer cylinder 50. Thus the flammable gas 4 can be ignited by the heat-radiation therefrom.

A control means for the filter recovery device is as follows.

As shown in FIG. 2(A), there are provided a rotation-number sensor 41 which senses the number of engine rotations, a load-detecting sensor 42 which senses the engine load, a back-pressure sensor 43 which senses the back pressure of the exhaust gas and an exhaust-gas temperature sensor 44 which senses the exhaust-gas temperature at the inlet of the load-detecting sensor 6. The load-detecting sensor 42 senses a rack position of a fuel-metering rack 45*a* of a fuel-injection pump 45. A liquid-fuel metering valve 47 is disposed in a liquid-fuel led-out passage 34 and an air-metering valve 46 is arranged in an air led-out passage 36. The rotation-number sensor 41, the load-detecting sensor 42, the back-pressure sensor 43 and the exhaust-gas temperature sensor 44 are associated with the liquid-fuel metering valve 47 and the air-metering valve 46 through a control means 19. Based on the number of the engine rotations, the engine load, the back pressure, and the exhaust-gas temperature, the control means 19 presumes how much the filter is clogged so as to judge whether or not it is necessary to recover the filter. On performing the filter-recovery, the control means 19 calculates the necessary production-amount of the flammable gas and adjusts the opening degree of each of the liquid-fuel metering valve 47 and the air-metering valve 46. There is further provided a catalyst-chamber temperature-detecting sensor 48 for sensing the temperature of the catalyst chamber 33, which is connected to the control means 19 so as to limit the increase and decrease of the supplied amount of either the liquid fuel or the air, so that the catalyst-chamber temperature is maintained within the predetermined range. This prevents the catalyst within the catalyst chamber 33 from being damaged by heat and besides retains a high yield of the flammable gas 4. The control means 19 is a micro-computer.

In addition, as shown in FIG. 2(A), a temperature-detecting means 17 for detecting how much the oxidation catalyst 8 is heated and an air-metering valve 18 is arranged in the air-supply passage 12. The air-metering valve 18 is associated with the temperature-detecting means 17 through the control means 19. Based on the temperature detected by the temperature-detecting means 17, the control means 19 adjusts the opening degree of the air-metering valve 18 so as to maintain the temperature of the oxidation catalyst 8 within the predetermined range.

The temperature-detecting means 17 detects how much the oxidation catalyst 8 is heated by detecting the temperature of the flammable gas 4 flowed from the oxidation catalyst 8 to the oxidation-catalyst downstream chamber 14. The temperature-detecting means 17 may detect the temperature of the oxidation catalyst 8.

FIG. 3 shows a second embodiment. This second embodiment differs from the first embodiment on the following points.

The metal cylinder 10 is made of a part separate from the terminal end portion 5*a* of the flammable-gas led-out pipe 5 and is supported through the partition wall 38 by the terminal end portion 5*a* of the flammable-gas led-out pipe 5. The outer cylinder 50 is composed of the terminal end portion 5*a* of the flammable-gas led-out pipe 5. The flammable gas 4 does not flow from the oxidation-catalyst downstream chamber 14 into the exhaust-gas heating passage 51. The metal cylinder 10 has an interior are a portion of which exists on the upstream side of the air-mixing passage 54 and is made to serve as a flammable-gas inlet chamber 11, in which the air-supply passage 12 is opened to provide the outlet 12*a*.

The other constructions and functions are the same as those of the first embodiment. In FIG. 3, the same elements as those in the first embodiment are indicated by same numerals.

What is claimed is:

1. An exhaust device for a diesel engine having a diesel engine exhaust gas (9) in an exhaust-gas route (7) upstream of a diesel-particulate-filter (6), the exhaust device using a supplied air (13) and a liquid fuel (3) from a liquid-fuel supply source (1) supplying the liquid fuel (3) to a gas generator (2) configured to convert the liquid fuel (3) to flammable gas (4) for burning exhaust-gas fine particles residual at the diesel-particulate-filter (6), the exhaust device comprising:

a flammable-gas led-out pipe (5) communicated with the gas generator (2) and the exhaust-gas route (7), the flammable-gas led-out pipe (5) having a terminal end portion (5*a*) disposed within the exhaust-gas route (7) upstream of the diesel-particulate filter (6);

a metal cylinder (10) arranged at the terminal end portion (5*a*) of the flammable-gas led-out pipe (5), the metal cylinder having an outer peripheral surface;

an oxidation catalyst (8) disposed within the metal cylinder (10) and an air-supply passage (12) on the upstream side of the oxidation catalyst (8), the air-supply passage (12) having an outlet (12*a*) arranged in the metal cylinder (10) to allow the supplied air (13) to merge with the flammable gas (4), wherein the flammable gas (4), upon merging with the supplied air (13) is burnt with the oxidation catalyst (8) to produce combustion heat radiating from the outer peripheral surface of the metal cylinder (10) into the exhaust gas (9) in the exhaust-gas route (7) heating the exhaust gas (9) mixing with the flammable gas (4) that has passed through the oxidation catalyst (8), the flammable-gas led-out pipe (5) enters the exhaust-gas route (7) by penetrating a peripheral wall thereof and has the terminal end portion (5*a*) to which the metal cylinder (10) is disposed along a central portion of the exhaust gas route (7), and the air-supply passage (12) enters the flammable-gas led-out pipe (5) by penetrating a peripheral wall thereof outside the exhaust-gas route (7) and has the outlet (12*a*) which is opened inside the flammable-gas led-out pipe (5) within the exhaust-gas route (7).

2. The exhaust device for a diesel engine as set forth in claim 1, wherein each of the terminal end portion (5*a*) of the flammable-gas led-out pipe (5) and the metal cylinder (10) has an axial direction extending along an axial direction of the exhaust-gas route (7), the metal cylinder (10) having an interior area a portion of which exists on a downstream side of the oxidation catalyst (8) and is made to serve as an oxidation-catalyst downstream chamber (14), which has an outlet opening (14*a*) directed toward a downstream side of the exhaust-gas route (7) as well as a terminal end opening (5*b*) of the flammable-gas led-out pipe (5).

3. The exhaust device for a diesel engine as set forth in claim 1, wherein a temperature-detecting means (17) for detecting how much the oxidation catalyst (8) is heated and an air-metering valve (18) is disposed in the air-supply passage (12), the air-metering valve (18) being associated with the temperature-detecting means (17) through a control means (19), the control means (19) adjusting an opening degree of the air-metering valve (18) based on a temperature detected by the temperature-detecting means (17), the oxidation catalyst (8) having a temperature maintained within a predetermined range.

4. The exhaust device for a diesel engine as set forth in claim 1, wherein the exhaust device includes the gas generator (2) and the gas generator (2) gasifies the liquid fuel (3) to convert it to the flammable gas (4).

5. The exhaust device for a diesel engine as set forth in claim 1, wherein the exhaust device includes the gas generator (2) and the gas generator (2) partially oxidizes the liquid fuel (3) to reform it to the flammable gas (4) which contains carbon monoxide and hydrogen.

6. The exhaust device for a diesel engine as set forth in claim 1, wherein within the exhaust-gas route (7), an outer cylinder (50) is provided coaxially with the metal cylinder (10) along an outer periphery of the metal cylinder (10) and an exhaust-gas heating passage (51) is provided between the metal cylinder (10) and the outer cylinder (50), part of the exhaust gas (9) in the exhaust-gas route (7) passing through the exhaust-gas heating passage (51), the combustion heat generated with the oxidation catalyst (8) being radiated from an outer peripheral surface of the metal cylinder (10) into the exhaust gas (9) in the exhaust-gas heating passage (51).

7. The exhaust device for a diesel engine as set forth in claim 6, wherein within the exhaust-gas heating passage (51), part of the exhaust gas (9) in the exhaust-gas route (7) is mixed with part of the flammable gas (4) that has passed through the oxidation catalyst (8).

8. The exhaust device for a diesel engine as set forth in claim 6, wherein the outer cylinder (50) is formed from metal and is thermo-conductively connected to the metal cylinder (10), the combustion heat generated with the oxidation catalyst (8) is also radiated from an inner peripheral surface of the outer cylinder (50) into the exhaust gas (9) in the exhaust-gas heating passage (51).

9. The exhaust device for a diesel engine as set forth in claim 1, wherein there is arranged between the outlet (12*a*) of the air-supply passage (12) and the oxidation catalyst (8), an air-mixing passage (54) in which a throttle orifice (52) and an expansion chamber (53) are alternately arranged and the flammable gas (4) is mixed with the supplied air (13).

10. The exhaust device for a diesel engine as set forth in claim 1, wherein the metal cylinder (10) comprises the terminal end portion (5*a*) of the flammable-gas led-out pipe (5).

11. The exhaust device for a diesel engine as set forth in claim 6, wherein the outer cylinder (50) comprises the terminal end portion (5*a*) of the flammable-gas led-out pipe (5).

12. The exhaust device for a diesel engine as set forth in claim 1, wherein on an upstream side of the filter (6), a downstream oxidation catalyst (57) is disposed downstream of the metal cylinder (10), so that the flammable gas (4) released from the metal cylinder (10) is burnt with the downstream oxidation catalyst (57).

13. An exhaust device for a diesel engine having a diesel engine exhaust gas (9) in an exhaust-gas route (7) upstream of a diesel-particulate-filter (6), the exhaust device using a supplied air (13) and a liquid fuel (3) from a liquid-fuel supply source (1) supplying the liquid fuel (3) to a gas generator (2) configured to convert the liquid fuel (3) to flammable gas (4) for burning exhaust-gas fine particles residual at the diesel-particulate-filter (6), the exhaust device comprising:

a flammable-gas led-out pipe (5) communicated with the gas generator (2) and the exhaust-gas route (7);

a terminal end portion (5*a*) of the flammable-gas led-out pipe (5), the terminal end portion (5*a*) being disposed within the exhaust-gas route (7) upstream of the diesel-particulate filter (6) and facing toward downstream of the exhaust-gas route (7);

a metal cylinder (10) arranged at the terminal end portion (5*a*) of the flammable-gas led-out pipe (5), the metal cylinder having an outer peripheral surface;

an oxidation catalyst (8) disposed within the metal cylinder (10);

an air-supply passage (12) in the terminal end portion (5*a*) of the flammable-gas led-out pipe (5) on the upstream side of the oxidation catalyst (8); and an air mixing passage (54) arranged between the outlet (12*a*) of the air-supply passage (12) and the oxidation catalyst (8), the air mixing passage (54) having a throttle orifice (52) and an expansion chamber (53) alternately arranged to mix the flammable gas (4) with the supplied air (13), wherein the flammable gas (4), upon merging with the supplied air (13) is burnt with the oxidation catalyst (8) to produce combustion heat, radiating from the outer peripheral surface of the metal cylinder (10) into the exhaust gas (9) in the exhaust-gas route (7) heating the exhaust gas (9) mixing with the flammable gas (4) that has passed through the oxidation catalyst (8), the flammable-gas led-out pipe (5) enters the exhaust-gas route (7) by penetrating a peripheral wall thereof and has the terminal end portion (5*a*) to which the metal cylinder (10) is disposed along a central portion of the exhaust-gas route (7), and the air-supply passage (12) enters the flammable-gas led-out pipe (5) by penetrating a peripheral wall thereof outside the exhaust-gas route (7) and has the outlet (12*a*) which is opened inside the flammable-gas led-out pipe (5) within the exhaust-gas route (7).

14. An exhaust device for a diesel engine having a diesel engine exhaust gas (9) in an exhaust-gas route (7) upstream of a diesel-particulate-filter (6), the exhaust device using a supplied air (13) and a liquid fuel (3) from a liquid-fuel supply source (1) supplying the liquid fuel (3) to a gas generator (2) configured to convert the liquid fuel (3) to flammable gas (4) for burning exhaust-gas fine particles residual at the diesel-particulate-filter (6), the exhaust device comprising:

a flammable-gas led-out pipe (5) communicated with the gas generator (2) and the exhaust-gas route (7), the flammable-gas led-out pipe (5) having a terminal end portion (5*a*) disposed within the exhaust-gas route (7) upstream of the diesel-particulate filter (6);

a metal cylinder (10) arranged at the terminal end portion (5*a*) of the flammable-gas led-out pipe (5);

an oxidation catalyst (8) disposed within the metal cylinder (10);

an air-supply passage (12) having an outlet (12*a*) disposed within the metal cylinder (10) on the upstream side of the oxidation catalyst (8); and an mixing passage (54) arranged between the outlet (12*a*) of the air-supply passage (12) and the oxidation catalyst (8), the mixing passage (54) configured to mix the flammable gas (4) with the supplied air (13), wherein the flammable-gas led-out pipe (5) enters the exhaust-gas route (7) by penetrating a peripheral wall thereof and has the terminal end portion (5*a*) to which the metal cylinder (10) is disposed along a central portion of the exhaust-gas route (7), and the air-supply passage (12) enters the flammable-gas led-out pipe (5) by penetrating a peripheral wall thereof outside the exhaust-gas route (7) and has the outlet (12*a*) which is opened inside the flammable-gas led-out pipe (5) within the exhaust-gas route (7).

* * * * *